US009976436B2

(12) United States Patent
Powell

(10) Patent No.: US 9,976,436 B2
(45) Date of Patent: May 22, 2018

(54) MOVABLE AIR SEAL FOR GAS TURBINE ENGINE

(71) Applicant: UNITED TECHNOLOGIES CORPORATION, Hartford, CT (US)

(72) Inventor: Brad Powell, Guilford, CT (US)

(73) Assignee: United Technologies Corporation, Farmington, CT (US)

( * ) Notice: Subject to any disclaimer, the term of this patent is extended or adjusted under 35 U.S.C. 154(b) by 283 days.

(21) Appl. No.: 14/779,602

(22) PCT Filed: Mar. 28, 2014

(86) PCT No.: PCT/US2014/032199

§ 371 (c)(1),
(2) Date: Sep. 24, 2015

(87) PCT Pub. No.: WO2014/160953

PCT Pub. Date: Oct. 2, 2014

(65) Prior Publication Data

US 2016/0047266 A1 Feb. 18, 2016

Related U.S. Application Data

(60) Provisional application No. 61/806,248, filed on Mar. 28, 2013.

(51) Int. Cl.

| | |
|---|---|
| ***F01D 11/24*** | (2006.01) |
| ***F01D 11/22*** | (2006.01) |
| ***F01D 11/20*** | (2006.01) |

(52) U.S. Cl.
CPC ..... *F01D 11/22* (2013.01); *F01D 11/20* (2013.01)

(58) Field of Classification Search
CPC ..... F01D 11/22; F01D 11/20; F01D 11/18; F01D 11/24
USPC ..... 415/1
See application file for complete search history.

(56) References Cited

U.S. PATENT DOCUMENTS

| | | | | | |
|---|---|---|---|---|---|
| 4,343,592 | A * | 8/1982 | May | F01D 11/22 | 415/127 |
| 4,632,635 | A * | 12/1986 | Thoman | F01D 11/24 | 415/14 |
| 4,826,397 | A * | 5/1989 | Shook | F01D 11/24 | 415/116 |
| 5,018,942 | A * | 5/1991 | Ciokajlo | F01D 11/22 | 415/127 |
| 5,056,988 | A | 10/1991 | Corsmeier et al. | | |
| 5,096,375 | A * | 3/1992 | Ciokailo | F01D 11/22 | 415/127 |
| 5,104,287 | A * | 4/1992 | Ciokajlo | F01D 11/22 | 415/126 |
| 5,116,199 | A * | 5/1992 | Ciokajlo | F01D 11/24 | 415/116 |
| 5,545,007 | A * | 8/1996 | Martin | F01D 11/22 | 415/118 |

(Continued)

*Primary Examiner* — Woody Lee, Jr.
*Assistant Examiner* — Brian Delrue
(74) *Attorney, Agent, or Firm* — Bachman & LaPointe, P.C.

(57) ABSTRACT

A blade tip clearance control system for an engine case of a gas turbine engine according to one disclosed non-limiting embodiment of the present disclosure includes an air seal segment within the engine case. A drive link extends through the engine case, the drive link mounted to the air seal segment.

14 Claims, 13 Drawing Sheets

(56) References Cited

U.S. PATENT DOCUMENTS

| | | | | |
|---|---|---|---|---|
| 5,601,402 | A * | 2/1997 | Wakeman | F01D 11/22 415/173.1 |
| 7,503,179 | B2 * | 3/2009 | Estridge | F01D 11/24 415/108 |
| 7,575,409 | B2 * | 8/2009 | Dierksmeier | F01D 11/22 415/1 |
| 7,597,537 | B2 * | 10/2009 | Bucaro | F01D 11/24 415/136 |
| 8,240,986 | B1 * | 8/2012 | Ebert | F01D 11/001 415/173.2 |
| 8,534,996 | B1 * | 9/2013 | Pankey | F01D 11/22 415/127 |
| 8,678,742 | B2 * | 3/2014 | Klingels | F01D 11/22 415/1 |
| 9,028,205 | B2 * | 5/2015 | Harris | F02C 9/16 415/173.1 |
| 2004/0071548 | A1 * | 4/2004 | Wilson, Jr. | F01D 11/18 415/173.1 |
| 2005/0031446 | A1 * | 2/2005 | Ress, Jr. | F01D 11/025 415/173.2 |
| 2007/0020095 | A1 * | 1/2007 | Dierksmeier | F01D 11/22 415/173.1 |
| 2007/0140838 | A1 * | 6/2007 | Estridge | F01D 11/24 415/178 |
| 2011/0076135 | A1 * | 3/2011 | Gendraud | F01D 11/24 415/119 |
| 2012/0063884 | A1 * | 3/2012 | Klingels | F01D 11/22 415/1 |

* cited by examiner

MOVABLE AIR SEAL FOR GAS TURBINE ENGINE

This application claims priority to U.S. Patent Appln. No. 61/806,248 filed Mar. 28, 2013.

BACKGROUND

The present disclosure relates to a gas turbine engine and, more particularly, to a blade tip clearance control system therefor.

Gas turbine engines, such as those that power modern commercial and military aircraft, generally include a compressor to pressurize an airflow, a combustor for burning a hydrocarbon fuel in the presence of the pressurized air, and a turbine to extract energy from the resultant combustion gases.

The compressor and turbine sections include rotatable blade and stationary vane arrays. Within an engine case structure, the radial outermost tips of each blade array are positioned in close proximity to a shroud assembly. Outer air seals of the shroud assembly are located adjacent to the blade tips such that a radial tip clearance is defined therebetween.

During engine operation, the thermal environment in the engine varies and may cause thermal expansion or contraction. Such thermal expansion or contraction may not occur uniformly in magnitude or rate such that the radial tip clearance varies.

The radial tip clearance is typically designed so that the blade tips do not rub under high powered operations such as take-off when the blade disk and blades expand as a result of thermal expansion and centrifugal loads. When engine power is reduced to the cruise condition, the radial tip clearance increases.

To facilitate engine performance, at least some engines include a blade tip clearance control system to maintain a close radial tip clearance.

SUMMARY

A blade tip clearance control system for an engine case of a gas turbine engine according to one disclosed non-limiting embodiment of the present disclosure includes an air seal segment within the engine case. A drive link extends through the engine case, the drive link mounted to the air seal segment.

In a further embodiment of the present disclosure, the drive link is mounted to the air seal segment at multiple points.

In a further embodiment of any of the foregoing embodiments of the present disclosure, the drive link is mounted to the air seal segment with a multiple fasteners.

In a further embodiment of any of the foregoing embodiments of the present disclosure the drive link is mounted to the air through bosses in the engine case.

A further embodiment of any of the foregoing embodiments of the present disclosure further comprises a spring arrangement between the drive link and the engine case.

In a further embodiment of any of the foregoing embodiments of the present disclosure, the spring arrangement is at least partially located within a pocket in the drive link.

A further embodiment of any of the foregoing embodiments of the present disclosure includes a continuous band that surrounds the engine case and is retained to the drive link through an attachment bracket.

In a further embodiment of any of the foregoing embodiments of the present disclosure, the continuous band slides through the attachment bracket.

A further embodiment of any of the foregoing embodiments of the present disclosure includes a split band that surrounds the engine case and is retained to the drive link through an attachment bracket.

In a further embodiment of any of the foregoing embodiments of the present disclosure, the split band slides through the attachment bracket.

A further embodiment of any of the foregoing embodiments of the present disclosure includes a split band that surrounds the engine case and is retained to the drive link through an attachment bracket.

A further embodiment of any of the foregoing embodiments of the present disclosure includes a control tube that surrounds the engine case and is retained to the drive link through an attachment bracket.

A further embodiment of any of the foregoing embodiments of the present disclosure includes a fitting in communication with the control tube to receive a secondary airflow into the control tube.

A further embodiment of any of the foregoing embodiments of the present disclosure includes a heating element in communication with the control tube to receive a secondary airflow into the control tube.

A gas turbine engine according to another disclosed non-limiting embodiment of the present disclosure includes a multiple of air seal segments inside an engine case. A multiple of drive links mounted outside the engine case, each of the multiple of drive links mounted to one of the multiple of air seal segments.

In a further embodiment of any of the foregoing embodiments of the present disclosure, the multiple of drive links are passively actuated.

In a further embodiment of any of the foregoing embodiments of the present disclosure, the multiple of drive links are actively actuated.

A method for blade tip clearance control of a gas turbine engine, according to another disclosed non-limiting embodiment of the present disclosure includes providing a load transfer capability that converts loads on a drive link outside an engine case to a multiple of points on an air seal segment inside the engine case.

A further embodiment of any of the foregoing embodiments of the present disclosure includes passively providing the load transfer capability.

A further embodiment of any of the foregoing embodiments of the present disclosure includes actively providing the load transfer capability.

The foregoing features and elements may be combined in various combinations without exclusivity, unless expressly indicated otherwise. These features and elements as well as the operation of the invention will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
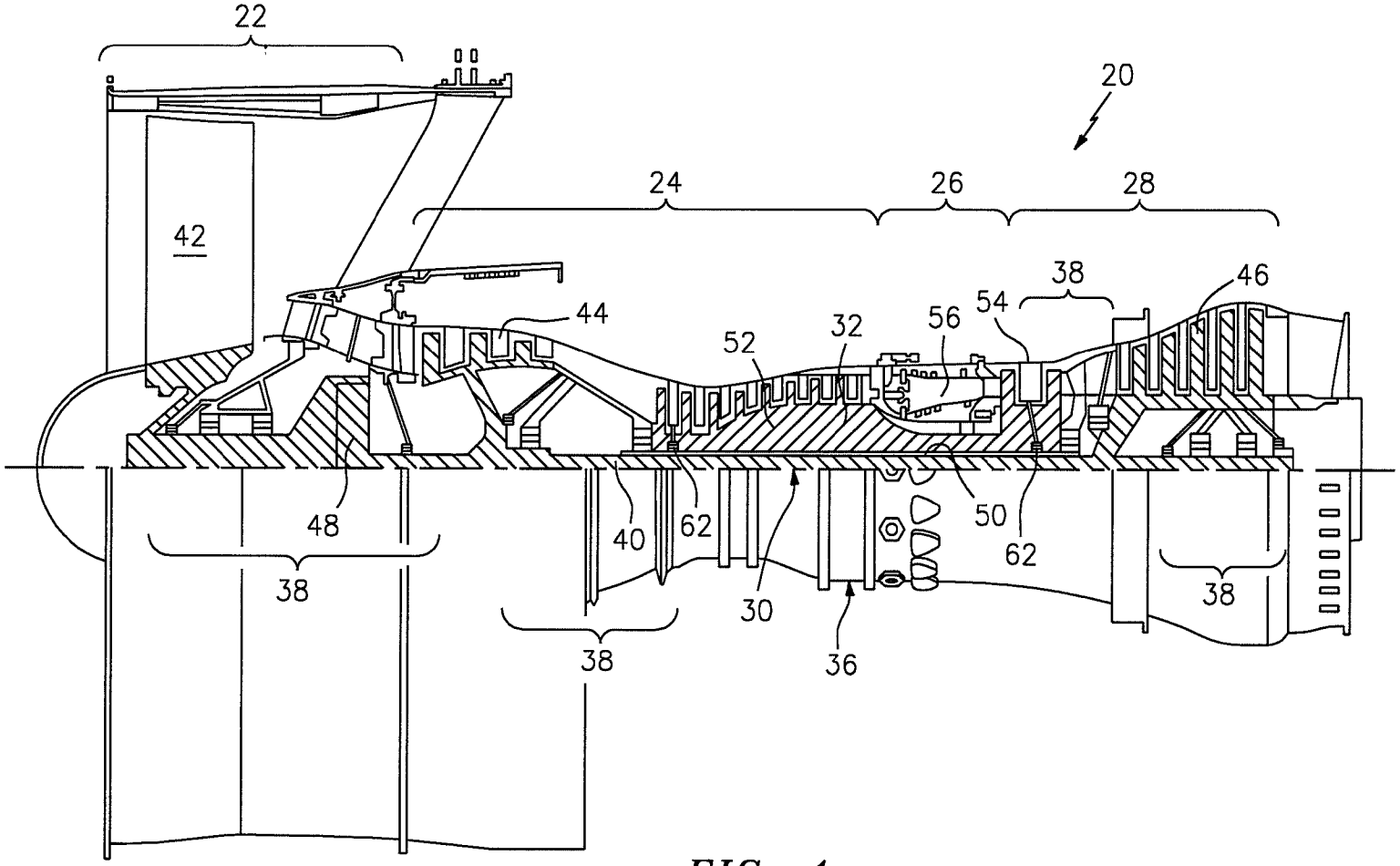
FIG. 1 is a schematic cross-section of one example aero gas turbine engine.

FIG. 1 schematically illustrates a gas turbine engine 20. The gas turbine engine 20 is disclosed herein as a two-spool turbo fan that generally incorporates a fan section 22, a compressor section 24, a combustor section 26 and a turbine section 28. Alternative engines might include an augmentor section (not shown) among other systems or features. The fan section 22 drives air along a bypass flowpath while the compressor section 24 drives air along a core flowpath for compression and communication into the combustor section 26 then expansion through the turbine section 28. Although depicted as a turbofan in the disclosed non-limiting embodiment, it should be appreciated that the concepts described herein are not limited to use with turbofans as the teachings may be applied to other types of turbine engines such as a turbojets, turboshafts, industrial gas turbines, and three-spool (plus fan) turbofans wherein an intermediate spool includes an intermediate pressure compressor ("IPC") between a Low Pressure Compressor ("LPC") and a High Pressure Compressor ("HPC"), and an intermediate pressure turbine ("IPT") between the high pressure turbine ("HPT") and the Low pressure Turbine ("LPT").

The engine 20 generally includes a low spool 30 and a high spool 32 mounted for rotation about an engine central longitudinal axis A relative to an engine static structure 36 via several bearing structures 38. The low spool 30 generally includes an inner shaft 40 that interconnects a fan 42, a low pressure compressor 44 ("LPC") and a low pressure turbine 46 ("LPT"). The inner shaft 40 drives the fan 42 directly or through a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor 52 ("HPC") and high pressure turbine 54 ("HPT"). A combustor 56 is arranged between the high pressure compressor 52 and the high pressure turbine 54. The inner shaft 40 and the outer shaft 50 are concentric and rotate about the engine central longitudinal axis "A" which is collinear with their longitudinal axes.

Core airflow is compressed by the LPC 44 then the HPC 52, mixed with the fuel and burned in the combustor 56, then expanded over the HPT 54 and the LPT 46. The turbines 54, 46 rotationally drive the respective low spool 30 and high spool 32 in response to the expansion. The main engine shafts 40, 50 are supported at a plurality of points by bearing structures 38 within the static structure 36. It should be appreciated that various bearing structures 38 at various locations may alternatively or additionally be provided.

In one non-limiting example, the gas turbine engine 20 is a high-bypass geared aircraft engine. In a further example, the gas turbine engine 20 bypass ratio is greater than about six (6:1). The geared architecture 48 can include an epicyclic gear train, such as a planetary gear system or other gear system. The example epicyclic gear train has a gear reduction ratio of greater than about 2.3, and in another example is greater than about 2.5:1. The geared turbofan enables operation of the low spool 30 at higher speeds which can increase the operational efficiency of the low pressure compressor 44 and low pressure turbine 46 and render increased pressure in a fewer number of stages.

A pressure ratio associated with the low pressure turbine 46 is pressure measured prior to the inlet of the low pressure turbine 46 as related to the pressure at the outlet of the low pressure turbine 46 prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 44, and the low pressure turbine 46 has a pressure ratio that is greater than about five (5:1). It should be appreciated, however, that the above parameters are only exemplary of one embodiment of a geared architecture engine and that the present disclosure is applicable to other gas turbine engines including direct drive turbofans.

In one embodiment, a significant amount of thrust is provided by the bypass flow path due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $(\text{"T"}/518.7)^{0.5}$ in which "T" represents the ambient temperature in degrees Rankine. The Low Corrected Fan Tip Speed according to one non-limiting embodiment of the example gas turbine engine 20 is less than about 1150 fps (351 m/s).

Figure 2:
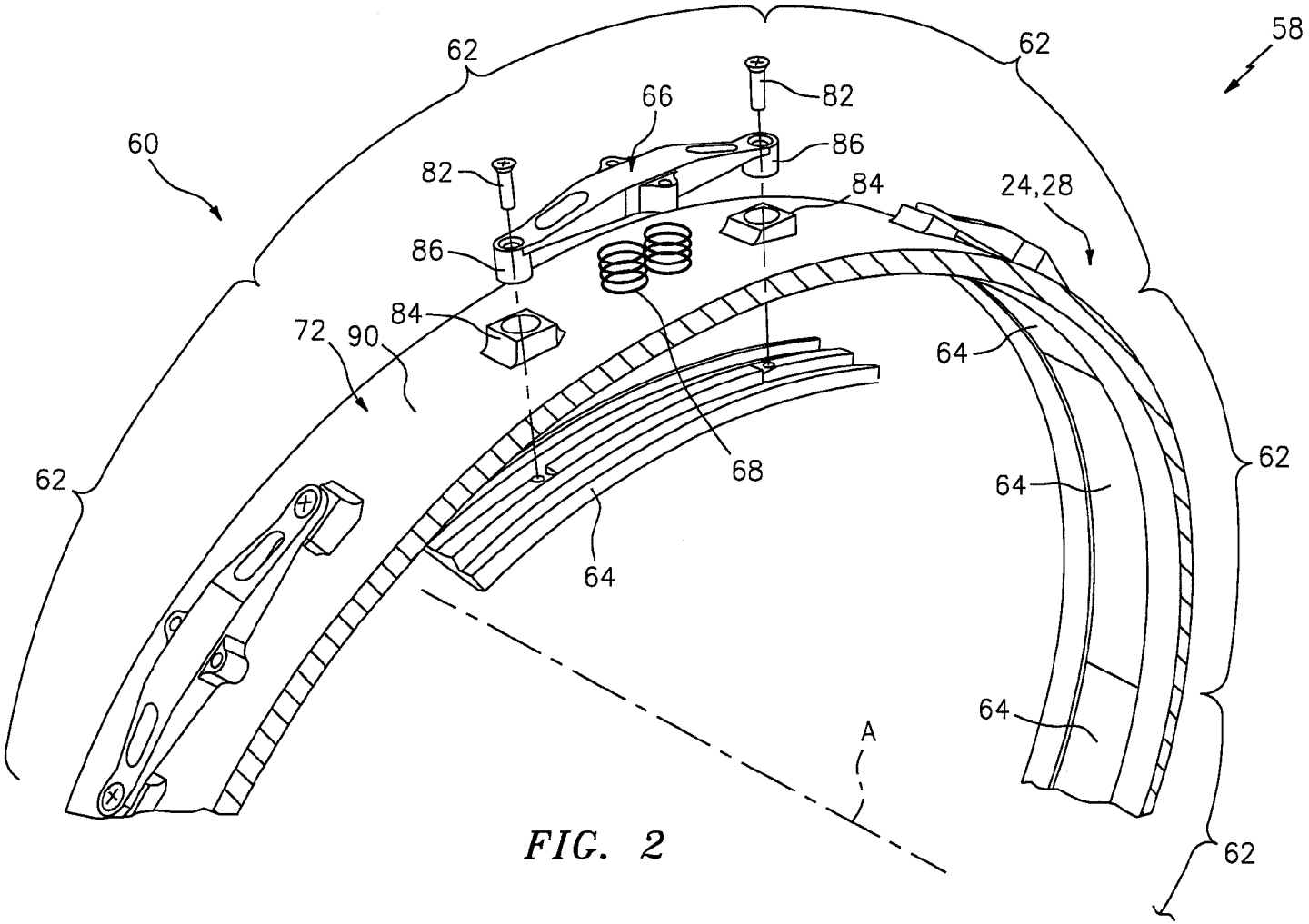
FIG. 2 is an is an enlarged partial sectional schematic view of a portion of a clearance control system according to one disclosed non-limiting embodiment.
Figure 3:
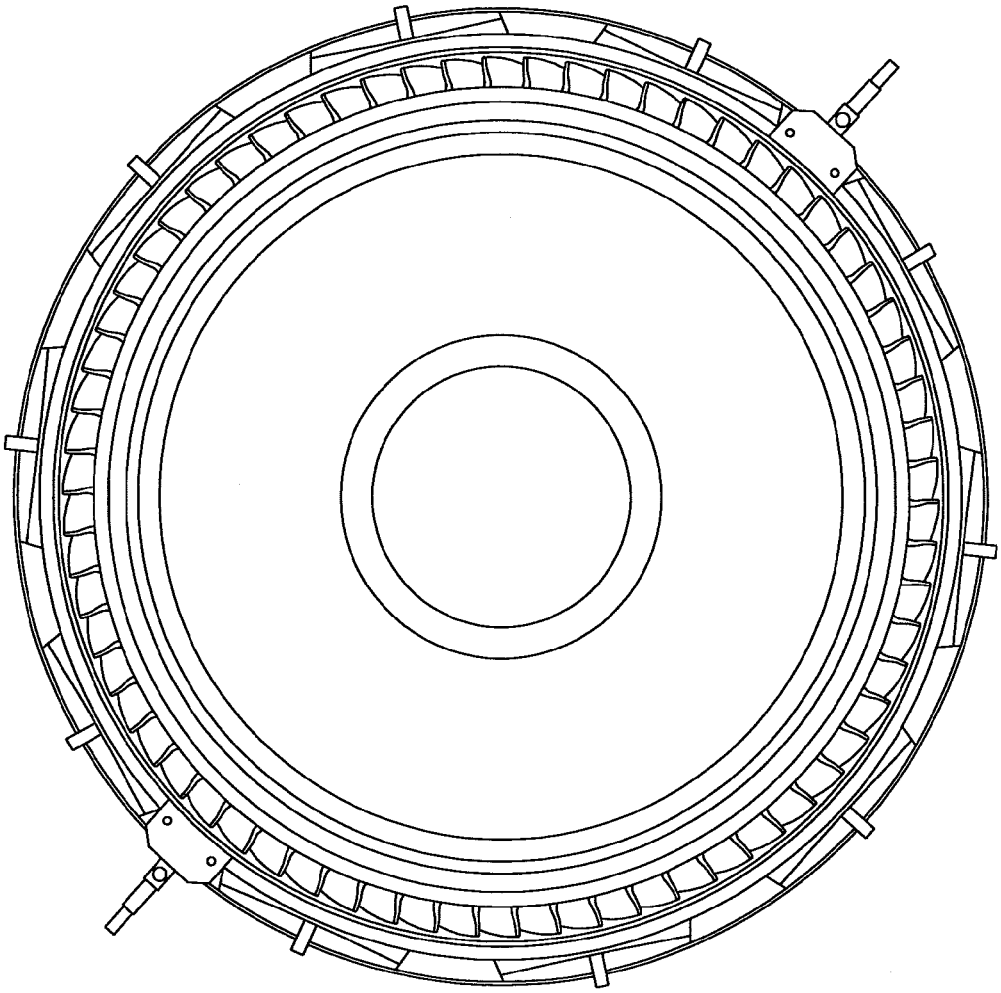
FIG. 3 is an enlarged partial sectional schematic view of a portion of a clearance control system and rotor therein.

With reference to FIG. 2, a blade tip clearance control system 58 includes a movable air seal system 60 that operates to control blade clearances inside a compressor section 24 and/or turbine section 28 (FIG. 3). The movable air seal system 60 may be arranged around each or particular stages within the gas turbine engine 20. That is, each rotor stage may have an associated movable air seal system 60 of the blade tip clearance control system 58.

Each movable air seal system 60 may be subdivided into a multiple of segments 62, each with a respective air seal segment 64, a drive link 66 and a spring arrangement 68. It should be appreciated that various other components may alternatively or additionally be provided.

Figure 4:
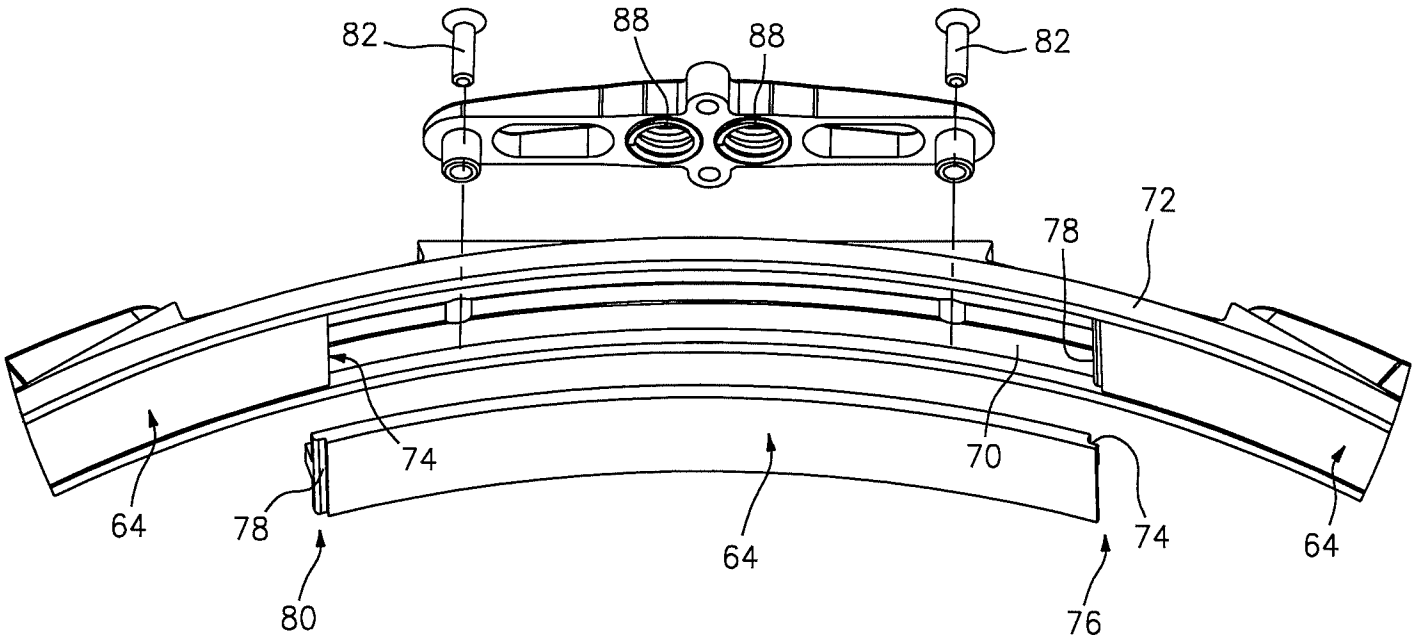
FIG. 4 is an enlarged partial sectional schematic view of one segment of the clearance control system.

With reference to FIG. 4, each respective air seal segment 64 in one disclosed non-limiting embodiment extends about thirty-six (36) degrees within a slot 70 of an engine case 72. It should be appreciated that any number of segments may be utilized wherein the segment angle is approximately 360°/n, where "n" is the number of segments. Each air seal segment 64 may be manufactured of a metal body with an abradable material on the inner radial surface, and include a groove 74 on one lateral edge 76 and a tab 78 on the other lateral edge 80 such that the array of the arcuate air seal segments 64 may expand and contract, yet maintain an air seal there between. That is, the array of the arcuate air seal segments 64 is movable to define an air seal of variable effective diameter. (i.e. "effective" in the sense that outward radial movement of the segments produces a slightly non-circular profile)

With reference to FIG. 2, each air seal segment 64 mates up rigidly to a respective drive link 66 by two guide studs 86 on the drive link 66. The guide studs 86 pass through respective holes in the bosses 84 of the engine case 72. Fasteners 82 pass through holes in the guide studs 86 of the drive link 66 to mate with respective threads in the air seal segment 64. The air seal segment 64 is thereby rigidly connected to the drive link 66 at the two locations where the guide studs 86 mate up with the air seal segment 64. The axes of the guide studs 86 and the holes in the bosses 84 are all parallel so as to allow radial inward and outward movement of each air segment 64 in tandem with the drive link 66. It should be appreciated that more than two parallel guide studs 86 and bosses 84 may be used to provide an even greater degree of support of the air seal segment 64. Seals may additionally be located, for example, between the bosses 84 and guide studs 86 to prevent airflow there through to both thermally and aerodynamically isolate the drive link 66 outside the case 72.

With continued reference to FIG. 2, the spring arrangement 68 may be located within pockets 88 in each drive link 66 (FIG. 4) to react against an outer surface 90 of the engine case 72. The spring arrangement 68 biases the respective air seal segment 64 outward with respect to the engine central longitudinal axis A. That is, the spring arrangement 68 permits a unidirectional load actuation technique wherein the return stroke is by spring action. Each drive link 66 may alternatively be used without spring arrangement 68 in cases where the load actuation technique provides two-way load transfer. Although coil springs are illustrated in the disclosed non-limiting embodiment, it should be appreciated that various bias members may alternatively or additionally be provided as the spring arrangement 68, e.g., wave springs, leaf springs, Belleville washers, etc.

With continued reference to FIG. 2, each drive link 66 is located on the outer surface 90 of the engine case 72 and is thereby fully isolated from conditions inside the compressor and/or turbine section, i.e. no thermal or aerodynamic interactions. Each drive link 66 operates to provide a load transfer capability that converts radial loads at a single point on the drive link 66 to multiple parallel points on the air seal segment 64. That is, the drive link 66 connects rigidly to the air seal segment 64 at two or more parallel locations via the fasteners 82, bosses 84 and guide studs 86 that provide mechanical support for the respective drive link 66 and air seal segment 64 set.

Figure 5:
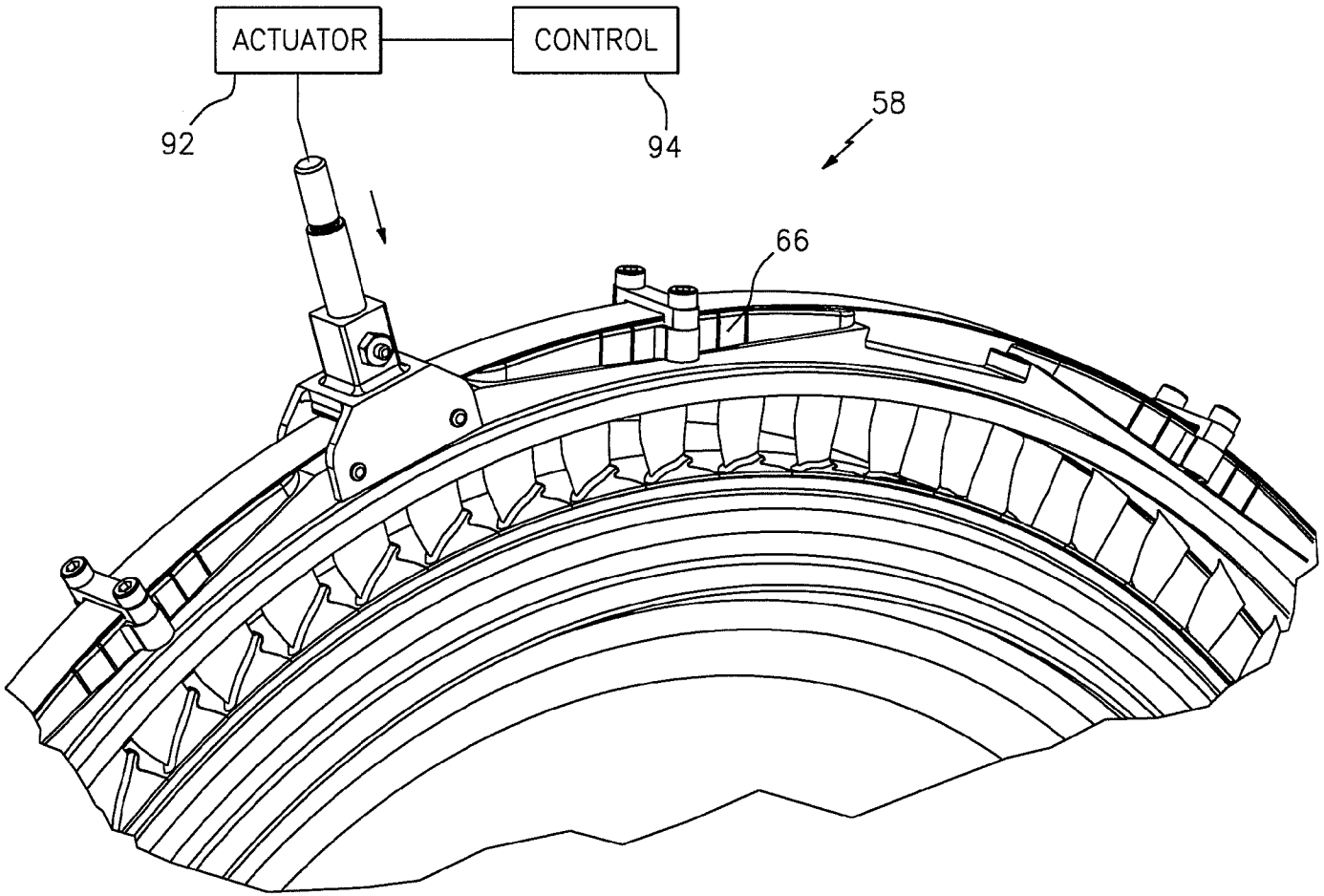
FIG. 5 is an enlarged partial sectional schematic view of a portion of the clearance control system.

With reference to FIG. 5, in one disclosed non-limiting embodiment, the blade tip clearance control system 58 further includes an actuator 92 that operates in response to a control 94. It should be appreciated that various other components such as sensors, actuators and other subsystems may be utilized herewith.

The control 94 generally includes a control module that executes seal movement logic. The control module typically includes a processor, a memory, and an interface. The processor may be any type of known microprocessor having desired performance characteristics. The memory may be any computer readable medium which stores data and control algorithms such as logic as described herein. The interface facilitates communication with other components such as a capacitive sensor or other gap sensor, and the actuator 92. The functions of the logic are disclosed in terms of functional block diagrams, and it should be understood by those skilled in the art with the benefit of this disclosure that these functions may be enacted in either dedicated hardware circuitry or programmed software routines capable of execution in a microprocessor based electronics control embodiment. In one non-limiting embodiment, the control module may be a portion of a flight control computer, a portion of a Full Authority Digital Engine Control (FADEC), a stand-alone unit or other system.

The actuator 92 may include a mechanical, electrical, hydraulic and/or pneumatic drive that operates to contract and expand the movable air seal system 60 in response to a control 94. That is, the actuator 92 may include various positionable members.

In one disclosed non-limiting embodiment, the actuator 92 is coupled to a continuous band 96 that surrounds the drive links 66 and is retained to each by an attachment bracket 98. The attachment bracket 98 may be generally rectilinear to receive the continuous band 96 therethrough. That is, the attachment bracket 98 permits the continuous band 96 to slide therethrough. The continuous band 96 is, for example, a flexible metal belt that may be selectively fixed to move each drive link 66. It should be appreciated that may alternatively include a series of smaller belts or members hinged at one or more locations.

Figure 6:
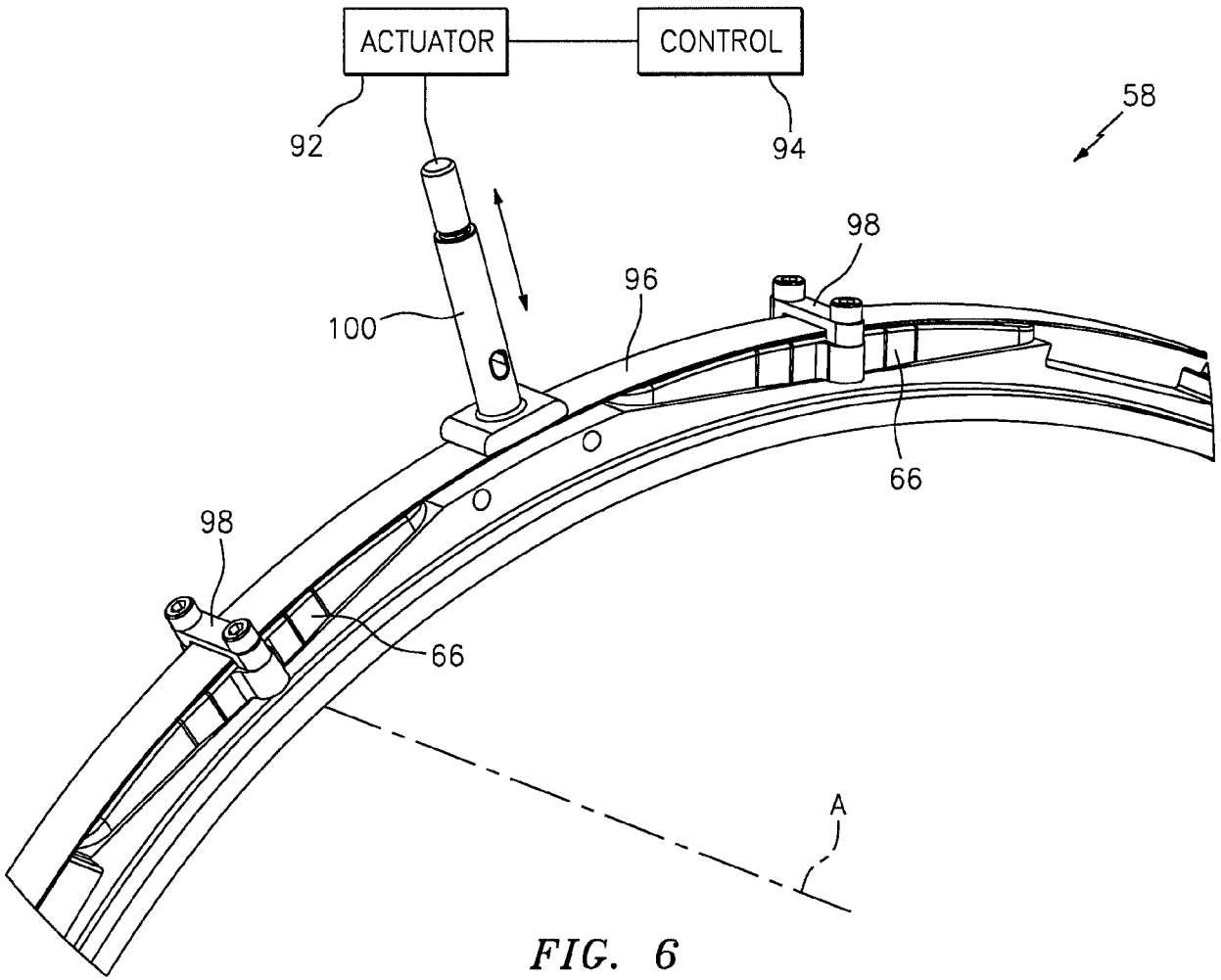
FIG. 6 is an enlarged partial sectional schematic view of a portion of a clearance control system according to another disclosed non-limiting embodiment.
Figure 7:
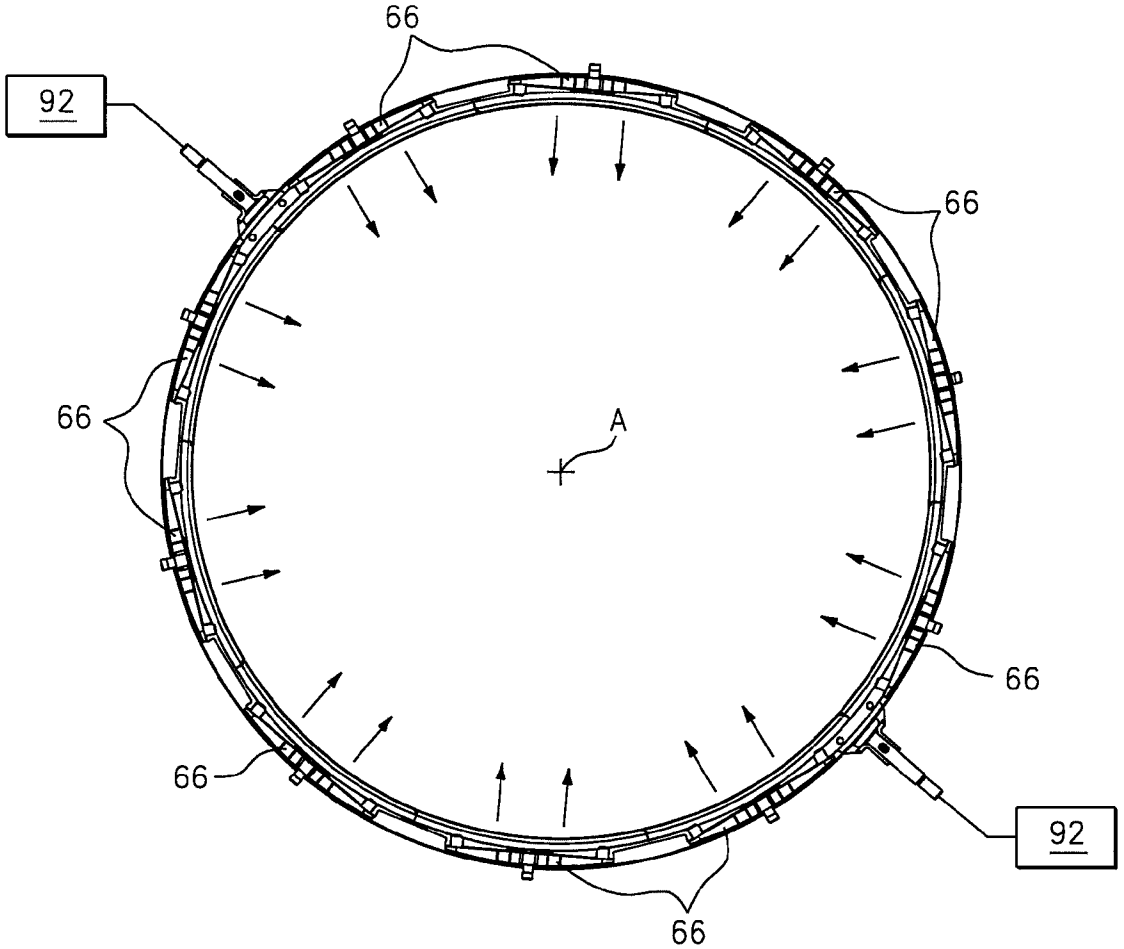
FIG. 7 is a schematic view of the clearance control system of FIG. 6 in a first position.

With reference to FIG. 6, one or more linear drive inputs 100 are selectively driven by the actuator 92 to place the continuous band 96 in tension and thereby compress the drive links 66. That is, the linear drive inputs 100 are driven toward the engine central longitudinal axis A to flex the continuous band 96 to eliminate slack, overcome the spring arrangement 68 and compress the drive links 66 to contract the array of air seal segments 64 (FIG. 7). The array of air seal segments 64 thereby provides a smaller inner diameter to reduce the radial tip clearance relative to the rotating blade tips. Release of the linear drive input 100 or extension away from the engine central longitudinal axis A permits the spring arrangement 68 to extend the drive links 66 and expand the array of air seal segments 64. The array of air seal segments 64 thereby provides a larger effective inner diameter to increase the radial tip clearance relative to the rotating blade tips.

Figure 8:
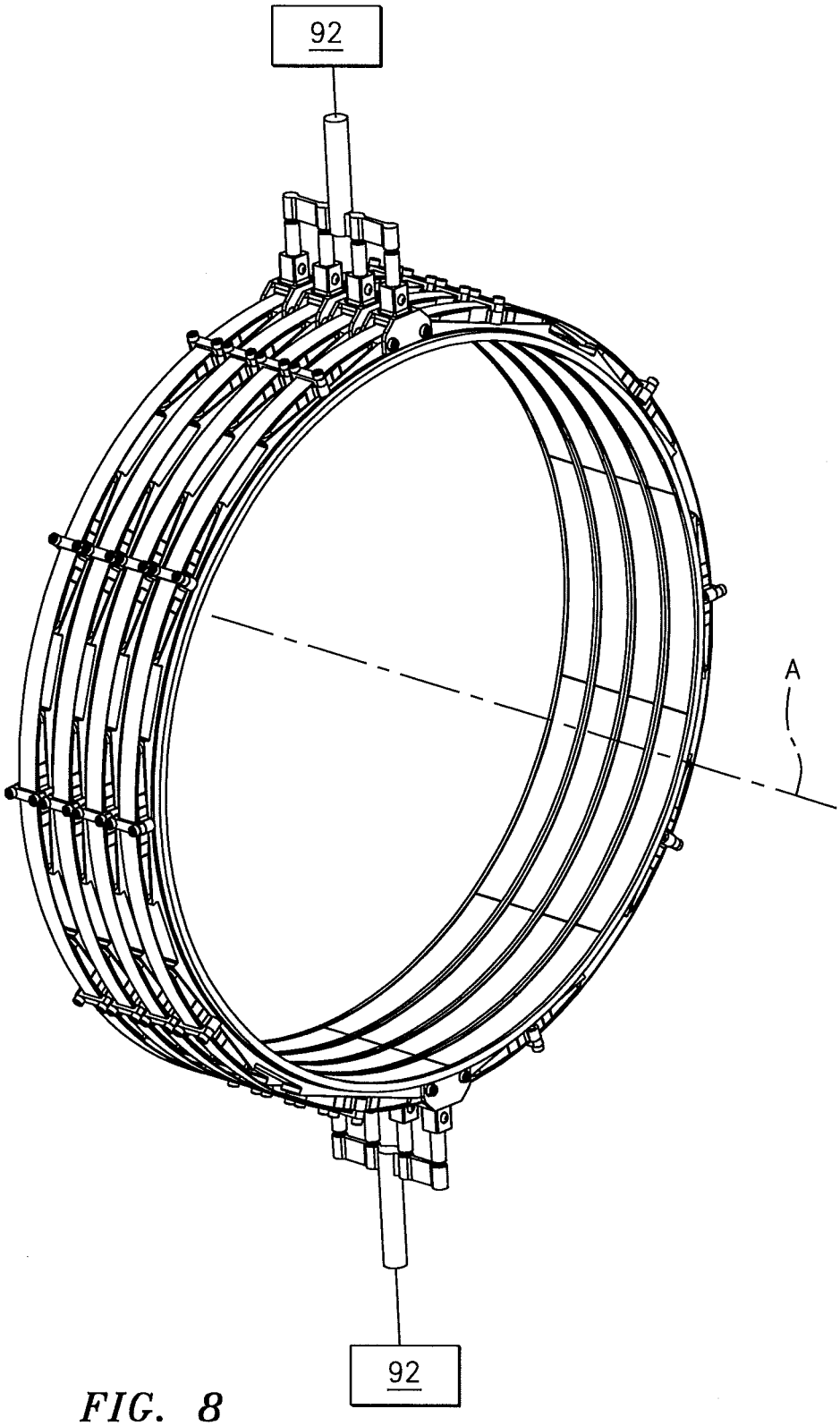
FIG. 8 is a partial sectional view of a clearance control system according to another disclosed non-limiting embodiment.

With reference to FIG. 8, in another disclosed non-limiting embodiment, the actuator 92 is coupled to multiple continuous bands 96 to actuate multiple stages simultaneously. It should be appreciated that multiple actuators 92 may additionally be provided.

Figure 9:
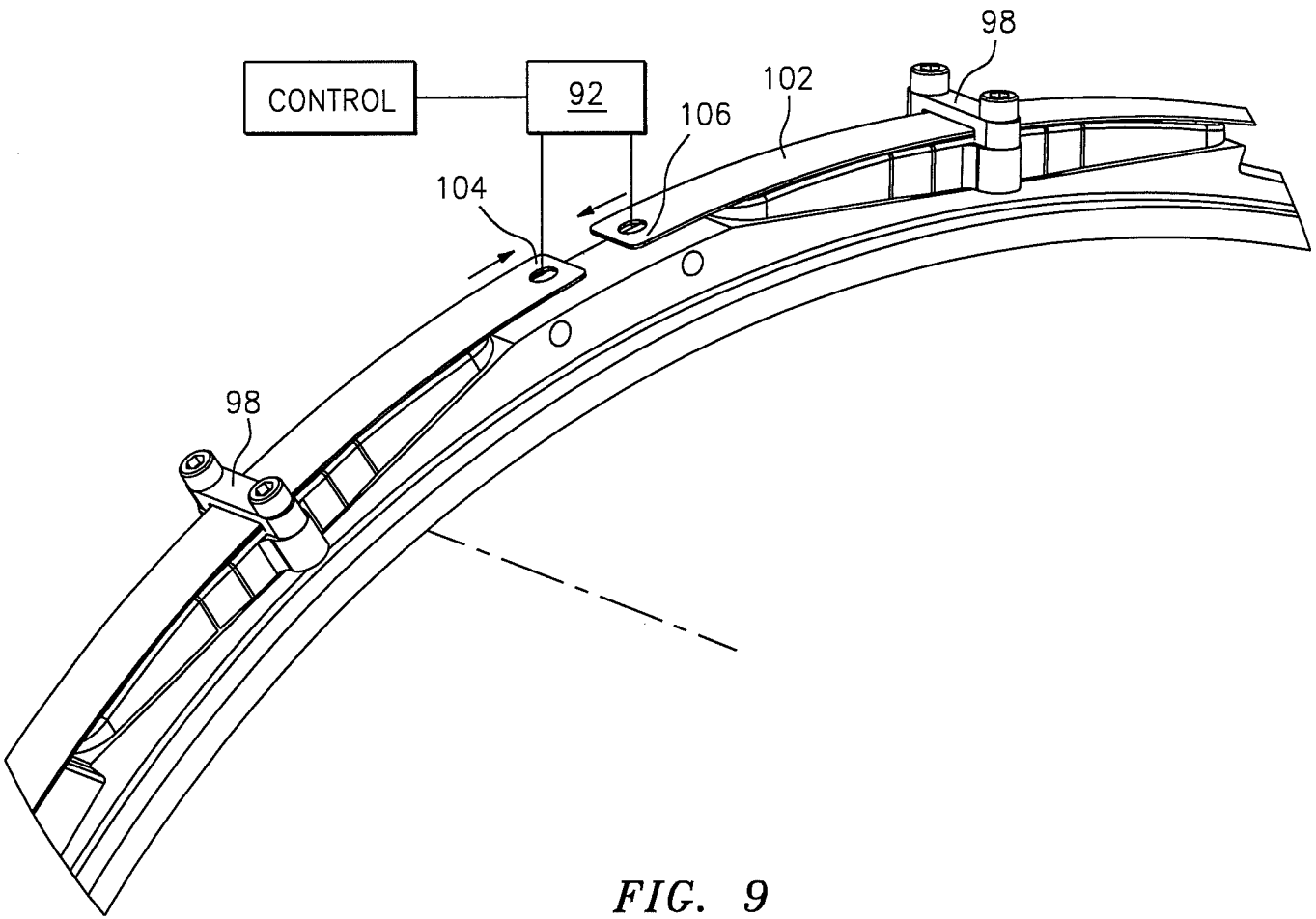
FIG. 9 is an enlarged partial sectional schematic view of a portion of a clearance control system according to another disclosed non-limiting embodiment.

With reference to FIG. 9, in another disclosed non-limited embodiment, a split band 102 which is retained similarly to the continuous band by attachment brackets 98 may be driven to tension by an actuator 92 which applies load in a tangential manner at attachment points 104 and 106.

Figure 10:
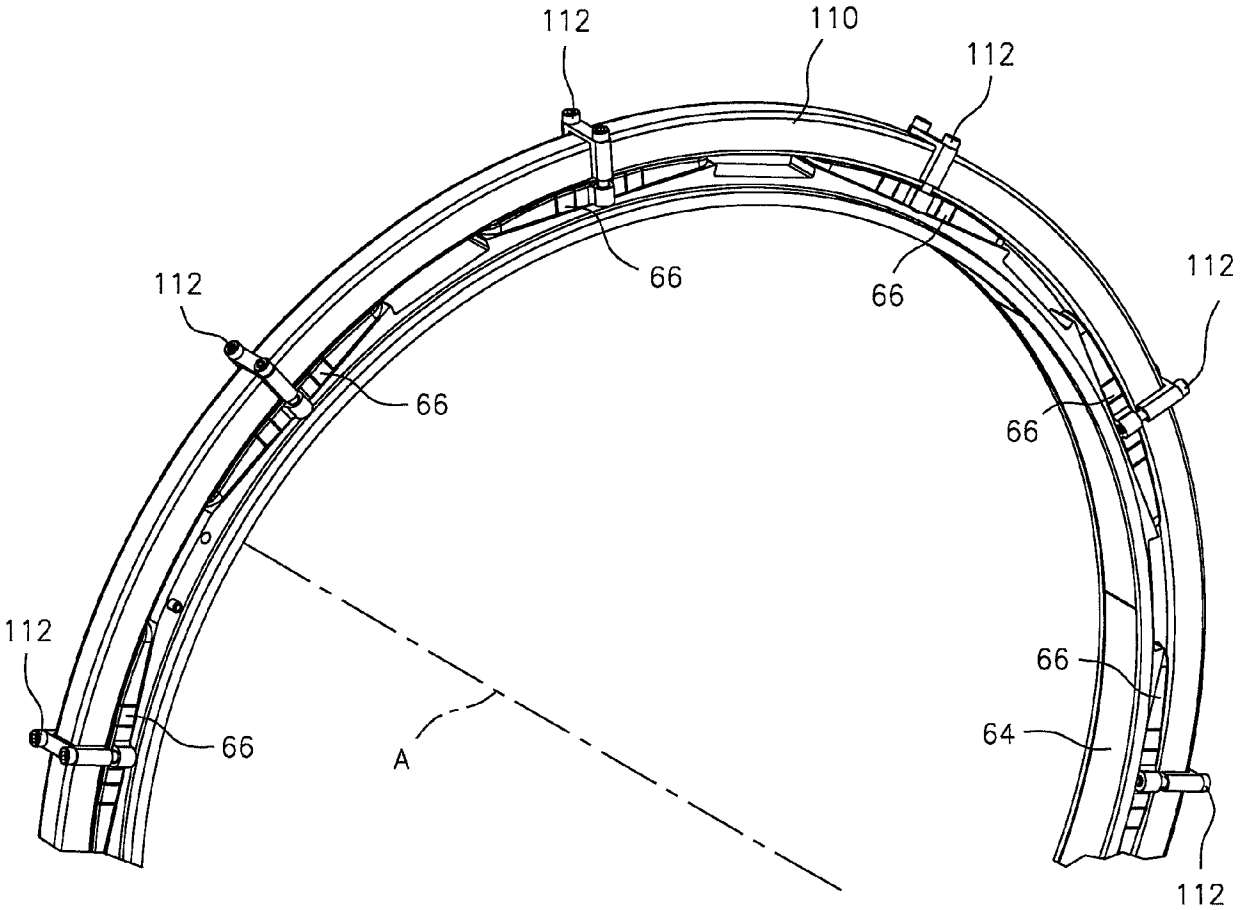
FIG. 10 is an partial sectional schematic view of a portion of a clearance control system according to another disclosed non-limiting embodiment.
Figure 11:
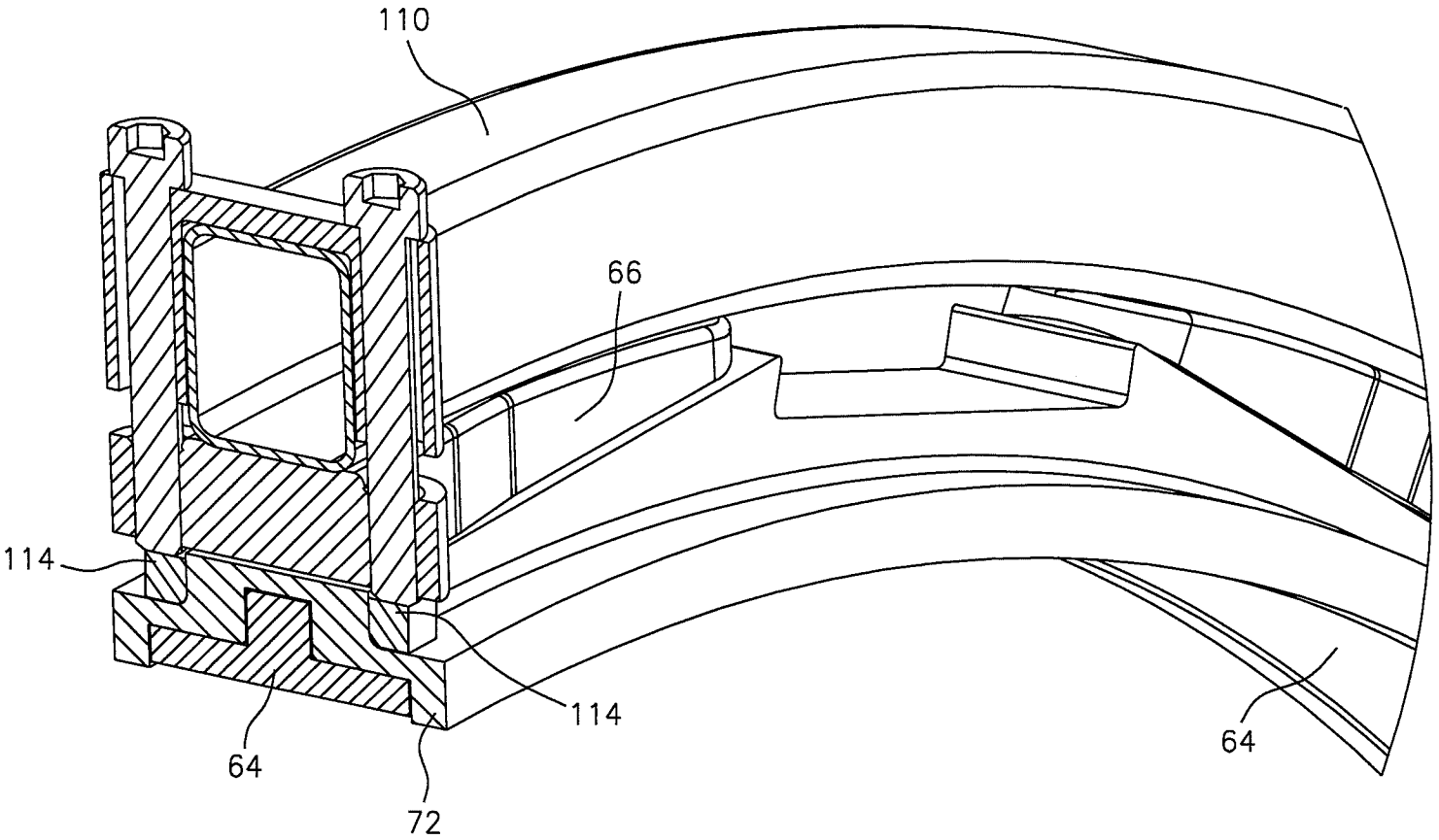
FIG. 11 is an enlarged partial lateral sectional schematic view of the clearance control system of FIG. 10.

With reference to FIG. 10, in another disclosed non-limiting embodiment, a control tube 110 surrounds the drive links 66 and is retained to each by an attachment bracket 112. The control tube 110 may be rectilinear in cross-section and manufactured of a metallic or non-metallic alloy (FIG. 11). It should be appreciated that various shapes may alternatively be provided.

The control tube 110 expands and contracts as a function of the local ambient temperature around the engine case 72. As a practical matter, the control tube 110 is isolated, both thermally and aerodynamically, from the conditions inside the compressor section 24 and/or turbine section 28. By material selection of the control tube 110, passive clearance control operations utilize the temperature differential inside and outside the control tube 110 to expand and contract the array of air seal segments 64 to thereby control the radial tip clearance relative the rotating blade tips.

With reference to FIG. 11, mechanical stops 114 (illustrated schematically) may interact with the array of air seal segments 64 and/or the drive links 66 so as to precisely index the expansion and contraction. In this manner, local temperature conditions around the engine case are harnessed to passively control blade clearances. For an example 18" (457 mm) compressor, the typical radial displacement of the array of air seal segments 64 is about 0.015" (15 mils; 0.38 mm). The array of air seal segments 64 are precisely movable between the mechanical stops 114 which can be set to a predetermined distance, for example, 0.010" (10 mils; 0.25 mm) for a relatively small compressors and 0.040" (40 mils; 1 mm) for a relatively large compressor. The displacement gap is, at least partially, a function of the engine core size and the dynamic conditions of a particular application.

Figure 12:
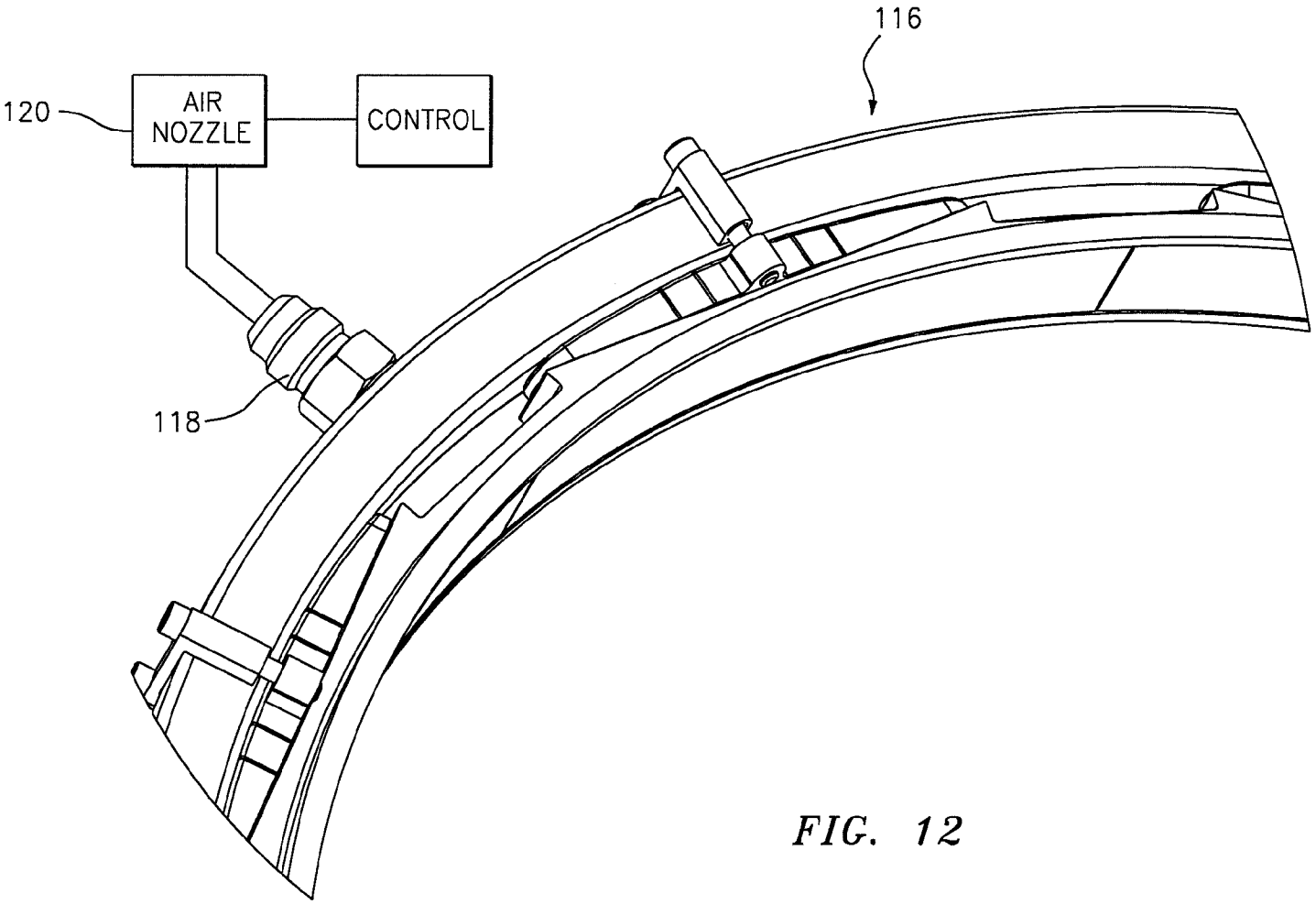
FIG. 12 is a partial sectional schematic view of a portion of a clearance control system according to another disclosed non-limiting embodiment.

With reference to FIG. 12, in another disclosed non-limiting embodiment, a control tube 116 may include a fitting 118 that receives a secondary airflow from upstream, downstream and/or ambient air sources 120. By control of the temperature of air, and the injection and release of the air from the control tube 116, active clearance control operations that utilize the temperature differential inside and outside the control tube 116 varies the radial tip clearance. It should be appreciated that fluids other than air may alternatively be utilized. The fluid may be exhausted at an exit fitting, or by one or more exit holes in the control tube 116.

Figure 13:
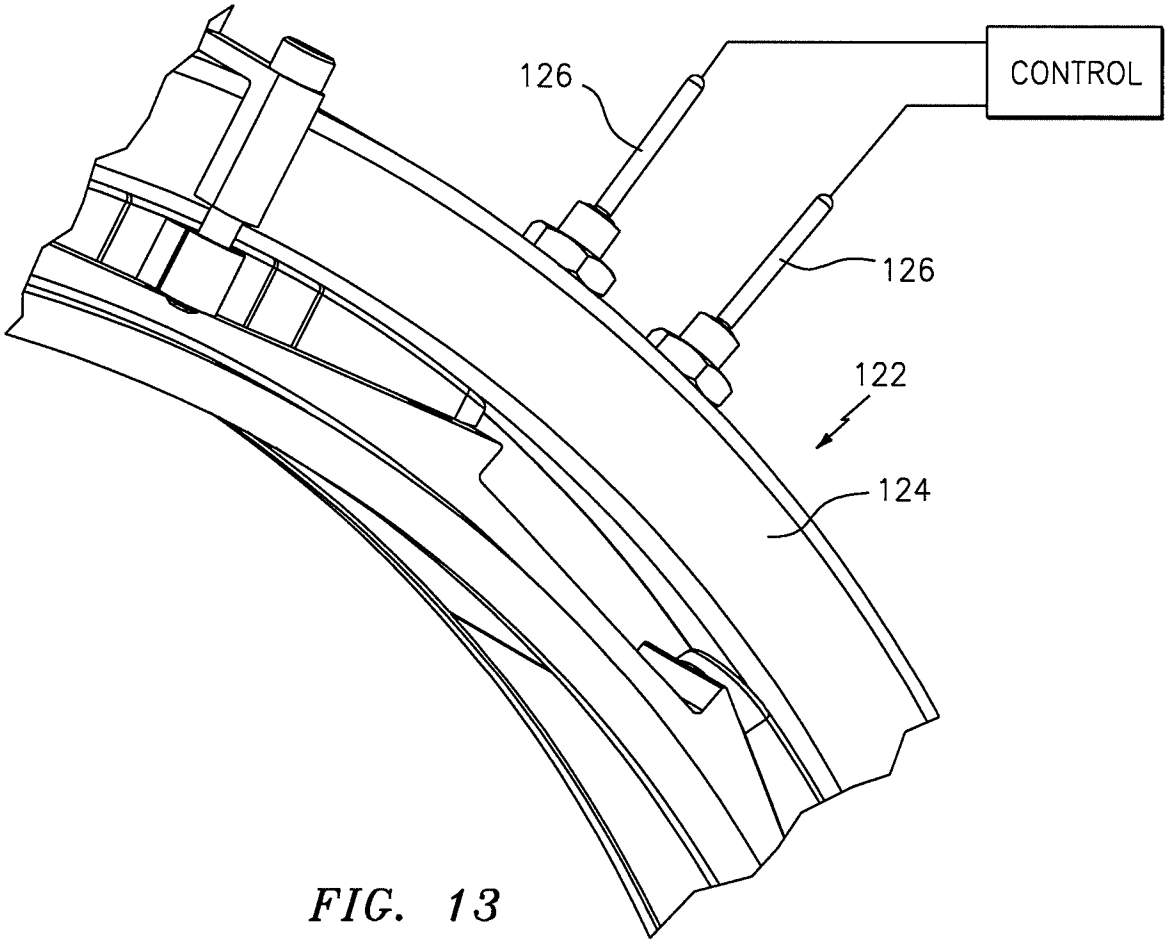
FIG. 13 is a partial sectional schematic view of a portion of a clearance control system according to one disclosed non-limiting embodiment.

With reference to FIG. 13, in another disclosed non-limiting embodiment, a control tube 122 may be exposed one or more to embedded heating elements 124 which selectively heat the control tube 122 to expand the control tube 122 when the heating element 124 is energized via power input pins 126. When the heating element is de-energized the control tube 122 contracts and thereby controls radial tip clearance. The control tube 122 may alternatively or additionally include fittings for various fluids and/or be manufactured of various thermally or electrically variable materials.

The movable air seal system 60 provides thermal and aerodynamic isolation from the engine interior; converts radial movement to parallel motion at two or more points on each segment of the air seal; is fully scalable to larger or small engine cores; and numerous actuation techniques may be utilized.

The use of the terms "a" and "an" and "the" and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to the normal operational attitude of the vehicle and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. A blade tip clearance control system for an engine case of a gas turbine engine comprising:

an engine case;

an air seal segment within the engine case;

a drive link that extends through the engine case, said drive link mounted to said air seal segment;

a control tube that surrounds the engine case and is retained to the drive link through an attachment bracket; and a heating element in communication with said control tube to selectively heat said control tube to control the blade tip clearance.

2. The blade tip clearance control system as recited in claim 1, wherein said drive link is mounted to said air seal segment at multiple points.

3. The blade tip clearance control system as recited in claim 1, wherein said drive link is mounted to said air seal segment with a multiple fasteners.

4. The blade tip clearance control system as recited in claim 1, wherein said drive link is mounted to said air seal segment through a boss in the engine case.

5. The blade tip clearance control system as recited in claim 1, further comprising a spring arrangement between said drive link and the engine case.

6. The blade tip clearance control system as recited in claim 5, wherein said spring arrangement is at least partially located within a pocket in said drive link.

7. The blade tip clearance control system as recited in claim 1, further comprising a continuous band that surrounds the engine case and is retained to the drive link through an attachment bracket.

8. The blade tip clearance control system as recited in claim 7, wherein said continuous band slides through said attachment bracket.

9. The blade tip clearance control system as recited in claim 1, further comprising a split band that surrounds the engine case and is retained to the drive link through an attachment bracket.

10. The blade tip clearance control system as recited in claim 9, wherein said split band slides through said attachment bracket.

11. The blade tip clearance control system as recited in claim 1, further comprising a fitting in communication with said control tube to receive a secondary airflow into said control tube.

12. A gas turbine engine comprising:

an engine case;

a multiple of air seal segments inside said engine case;

a multiple of drive links mounted outside said engine case, each of said multiple of drive links mounted to one of said multiple of air seal segments;

a control tube that surrounds the engine case and is attached to the multiple of drive links; and a heating element in communication with said control tube to selectively heat said control tube to control a blade tip clearance.

13. The blade tip clearance control system as recited in claim 12, wherein said multiple of drive links are passively actuated by said control tube.

14. The blade tip clearance control system as recited m claim 12, wherein said multiple of drive links are actively actuated by said control tube.

* * * * *